US008209918B1

(12) United States Patent
Voit

(10) Patent No.: US 8,209,918 B1
(45) Date of Patent: Jul. 3, 2012

(54) APPARATUS AND MEANS FOR THE INTERNMENT OF CREMATED REMAINS ABOVE A PRE-EXISTING COFFIN BURIAL

(76) Inventor: Troy D. Voit, Oconomowoc, WI (US)

( * ) Notice: Subject to any disclaimer, the term of this patent is extended or adjusted under 35 U.S.C. 154(b) by 155 days.

(21) Appl. No.: 12/700,951

(22) Filed: Feb. 5, 2010

(51) Int. Cl.
*E04H 13/00* (2006.01)

(52) U.S. Cl. ..... 52/133; 52/103; 52/128; 52/136

(58) Field of Classification Search ..... 52/38, 103, 52/133, 134, 128, 131, 136
See application file for complete search history.

(56) References Cited

U.S. PATENT DOCUMENTS

| | | | |
|---|---|---|---|
| 1,585,411 | A | 5/1926 | Patterson |
| 3,529,730 | A | 9/1970 | Thompson |
| 3,726,052 | A | 4/1973 | Thompson |
| 3,754,805 | A | 8/1973 | Pangburn et al. |
| 4,521,999 | A | 6/1985 | Flanagan |
| 5,080,251 | A | 1/1992 | Noack |
| D433,209 | S | 10/2000 | Baldwin et al. |
| 6,944,921 | B1 | 9/2005 | Gersten |
| D541,002 | S | 4/2007 | Biggar |
| 7,287,306 | B1 | 10/2007 | Green |
| 2006/0179624 | A1 | 8/2006 | Glass |

*Primary Examiner* — Basil Katcheves
(74) *Attorney, Agent, or Firm* — John McCormick

(57) ABSTRACT

Provided herewith is an apparatus and means for interning a plurality of cremated remains and their accompanying urns in a columbarium placed in the ground above a pre-existing coffin style burial such that the ashes and urns are inaccessible once they are interned. The apparatus comprises an "L" shaped columbarium that is placed above a pre-existing coffin with the longer side of the "L" shape being laid horizontally. A telescoping cylinder is utilized to hold the urn for viewing during the ceremony and to deposit the urn in storage. As the telescoping cylinder is lowered back into the columbarium, a push arm forces the pivotal plate to pivot causing the urn to roll off the pivotal plate and onto a ramp that allows the urn to continue by gravitational force to the base of the ramp for permanent storage.

16 Claims, 13 Drawing Sheets

APPARATUS AND MEANS FOR THE INTERNMENT OF CREMATED REMAINS ABOVE A PRE-EXISTING COFFIN BURIAL

FIELD OF THE INVENTION

The field of this invention relates generally to the storing of cremated remains, and more specifically to storing multiple cremated remains underground in a non-accessible multi-unit columbarium pod located directly above a pre-existing traditional style coffin of a related family member or other group.

BACKGROUND OF THE INVENTION

Throughout recorded history, cultures and civilizations have utilized rituals and ceremonies to commemorate the loss of a loved one or a member of the community. These ceremonies can be extremely large and ornate, such as for individuals with a high public profile or high political office, or they can be simple and reserved ceremonies. The rituals and ceremonies serve a variety of needs. One of those needs is to provide a means of closure for the surviving members of the community and to aid the living in coping with the loss of someone dear to them.

In many instances, a family will choose to be interned in a common plot or location for eternity. For example, a family plot may contain burial spaces for a husband and wife, their parents or grandparents, their brothers and/or sisters, their children and their spouses and so forth depending upon the circumstances and desires of the deceased. Familial plots are common and serve both to remember the deceased as well and recognizing those that have gone before them. It also provides a sense that the deceased in still with family. In many instances, the deceased has chosen to be embalmed and interned in a coffin in the ground. In other instances, the deceased has chosen to be cremated. Cremation has gained in popularity mainly because it is less costly and consumes less land space. For those electing cremation, there are many options as to what can be done with their cremated remains. Some elect to have their remains scattered over some specified location, either on earth or in space. Others elect to have their remains placed in a suitable urn, which can either be kept by the deceased's family or placed in an above ground communal columbarium or in a familial columbarium, either above or below ground. Many prefer a familial columbarium over a communal one for the sense of history and family is represents.

Interning cremated remains in a communal columbarium over conventional whole-body casket burials is attractive to cemetery owners, mostly due to the reduced space requirements which frees up available space for future burials. A familial columbarium, while requiring less space than a casket burial can still consume more space than a communal columbarium as the urns are typically placed side by side in a horizontal position. In addition, when a newly deceased individual's remains are added to the familial plot, it may necessary to open the familial columbarium to place the new urn in the columbarium thereby providing access to the prior interned urns.

Presently, when urns of recently deceased individuals are placed within a familial plot where a coffin has previously been interned, it is standard practice to place the urn in a spot next to the previously interned coffin along with an additional headstone commemorating the recently deceased's particulars. In other embodiments, the headstone may have been provided at the initial coffin burial to allow for the recently deceased's particulars to be recorded on the existing headstone.

Given that many cemeteries have already reached full capacity, or are coming close to being at full capacity, a need exists to provide a means to utilize the existing cemetery space to allow for the internment of additional family or group members without the addition of land to do so.

In order to make more efficient use of cemetery space is desirable therefore to have a columbarium that can store a plurality of cremated remains in a more space efficient manner to better utilize the limited supply of cemetery land while assuring that there is no access to prior interned cremated remains.

SUMMARY OF THE INVENTION

The apparatus and method of the present invention is directed towards using a buried columbarium pod that is placed over an existing coffin style burial plot of a prior deceased familial or other group member. In a preferred embodiment, a hole is dug into the ground above an existing coffin over the entire length of the existing coffin less the amount the headstone occupies. An "L" shaped columbarium pod, laid with the long part of the "L" shape horizontally in the ground, is secured into the hole by the use of securing pads attached to both ends of the columbarium pod and into or over which concrete or other securing material is poured. The hole is then filled in around the columbarium pod and on top of the long side of the "L" shaped pod. The short portion of the "L" shaped pod remains above ground providing access into the pod for the deposition of additional urns at later dates. The names and other particulars of the cremated individual can be recorded on the top of the exposed "L" shaped columbarium. On the inside top of the columbarium pod there is a circular opening with a cylindrical tube attached thereto extending from slightly above an inner horizontal surface inside the columbarium pod to a position near the bottom of the pod. Placed inside of the cylindrical tube is a telescoping cylinder with a pivoting, spring loaded base plate with a plurality of extended tabs at the base of the telescoping tube. The tabs align with a plurality of vertical slots in the cylindrical tube such that the tabs slide in the vertical slot in an up and down direction when the telescoping tube is lifted upward or slide down to its resting position. When the telescoping tube is in its full upward position, the telescoping tube can be rotated slightly in horizontal slots connected to the vertical slots to maintain the telescoping tube in a fully upward position. The telescoping cylinder has a spring loaded base plate which is biased in a horizontal position when the telescoping tube is pulled upward from its full returned position in the cylindrical tube. The spring loaded base plate has a small depression the in the center of the base place meant to receive the round urn. Thus, when the telescoping tube is in its fully upward position and resting in the horizontal slots, the urn can be placed securely in the depression in the pivoting base plate for viewing during the internment ceremony.

At the end of the ceremony, the telescoping tube is rotated back toward the vertical slots and dropped downward in the cylindrical tube. Upon reaching the bottom of the cylindrical tube, a push arm attached to the pivoting base plate overcomes the spring bias of the base plate and tips the base plate such that the urn is able to roll out of the telescoping tube. The telescoping tube and the cylindrical tube having openings aligned to allow the urn to roll out of the telescoping and cylindrical tubes. The urn rolls onto a pitched ramp, adjacent to the cylindrical tube, inside of the longer side of the "L" shaped columbarium to its final resting place.

The top of the telescoping cylinder has a handle and means for securing the telescoping cylinder near the top of the columbarium pod. In the alternative, there could be a plurality of vertically stacked ramps, each with one end open to the cylindrical tube and the ramp in the telescoping cylinder. The trays being separated from each other by the underside of the preceding tray. In another embodiment, there are a plurality of trays that lay horizontally next to each other rather than in a vertical stacking arrangement. The trays being separated from each other by the side walls between the horizontally laid trays.

In use, a user would un-secure the telescoping cylinder, raise the telescoping cylinder and the rotate the telescoping cylinder to secure it in an upward position. They would then place a spherical urn, with the cremated remains in the urn, onto the spring biased base plate for viewing during the internment proceedings. The user then rotates the telescoping cylinder backwards into the vertical slot and slides the telescoping cylinder back down the cylindrical tube to its full depth. When the telescoping cylinder reaches the bottom of the cylindrical tube, the push arm overcomes the spring biased plate, pivoting the base plate and allowing the urn to roll out and down the ramp, by gravity, to its final resting place. The telescoping cylinder is designed with tabs at the bottom of the cylinder such that the cylinder can be rotated and raised or lowered, but it can not be removed from the cylindrical tube. Thus, once a spherical urn is placed into the columbarium, the urns are secured from any further access. Other mementos, pictures, treasures or other items significant to the deceased or family members can then be placed into a spherical container and similarly deposited next to the previously interned urn. In addition, deoxyribonucleic acid, or DNA, samples or other items can be identified and placed into the storage container opening and secured with a locking storage container lid if desired.

Once interned, a commemorative plaque can be engraved with the name and particulars of the deceased and their location in the columbarium and placed inside the columbarium lid on a ring binder like holder or other such commemorative plaque type arrangements.

In the alternative, the inside of the top columbarium cover can be inscribed with the deceased's particulars. Other means for recording the particulars of a deceased are well know in the art.

Other features and advantages of this disclosure will become apparent to one skilled in the art upon examination of the following drawings and detailed description. It is intended that all such additional features and advantages be included within the scope of the present invention.

BRIEF DESCRIPTION OF THE DRAWINGS

A system and a method according to the invention will be described in more detail by means of a preferred embodiment with reference to the appended drawings in which.

DETAILED DESCRIPTION OF THE INVENTION

Figure 1:
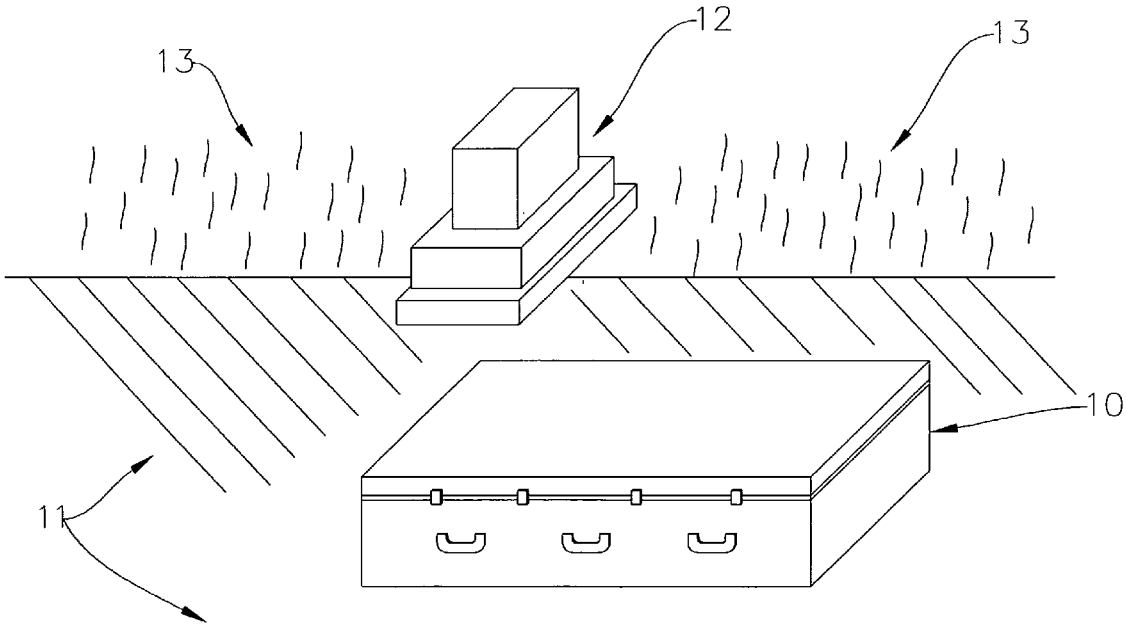
Fig:1 Prior Art
FIG. 1 is a prior art perspective side view of a traditional coffin style burial with an above ground commemorative headstone.

Reference will now be made in detail to the description of the invention as illustrated in the drawings. Although the invention is described in connection with the drawings, there is no intent to limit the invention to the embodiment or embodiments disclosed therein. On the contrary, the intent is to include all alternatives, modifications, and equivalents included within the scope and spirit of the invention as defined by the appended claims.

Referring to the prior art as shown in FIG. 1, there is depicted a prior interned coffin 10 buried in the ground 11 with a headstone 12 marking the deceased individuals particulars placed above ground 13 and secured underneath the ground 11.

Figure 2:
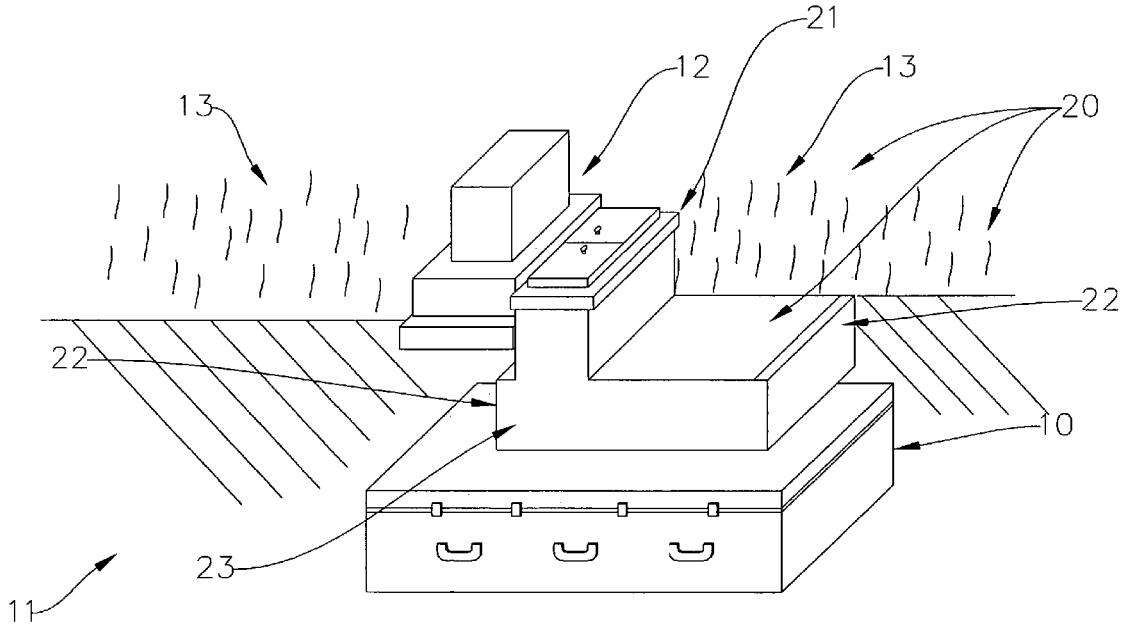
FIG. 2 is perspective side view of the present invention placed above previously interned coffin style burial.

Referring to FIG. 2, the cremation storage apparatus 20 of the present invention (also commonly known as a columbarium) is depicted in a first preferred embodiment installed in the ground 11 with the top portion of the columbarium 21 projecting above the ground 13. There are a plurality of anchoring means 22 attached to the base 23 of the columbarium to secure the columbarium 20 into the ground 11. Concrete, dirt or other means can be utilized to secure the columbarium 20 into the ground 11. Dirt and back fill are then filled in on top of and around the columbarium 20.

Figure 3:
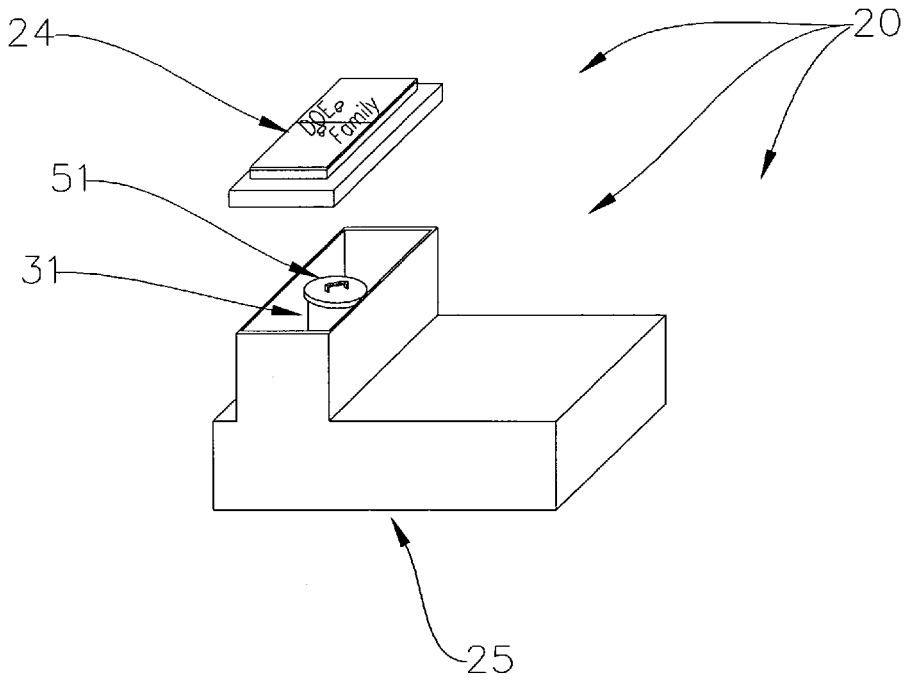
FIG. 3 is a perspective view of the present invention with the lid of the columbarium raised up.
Figure 4:
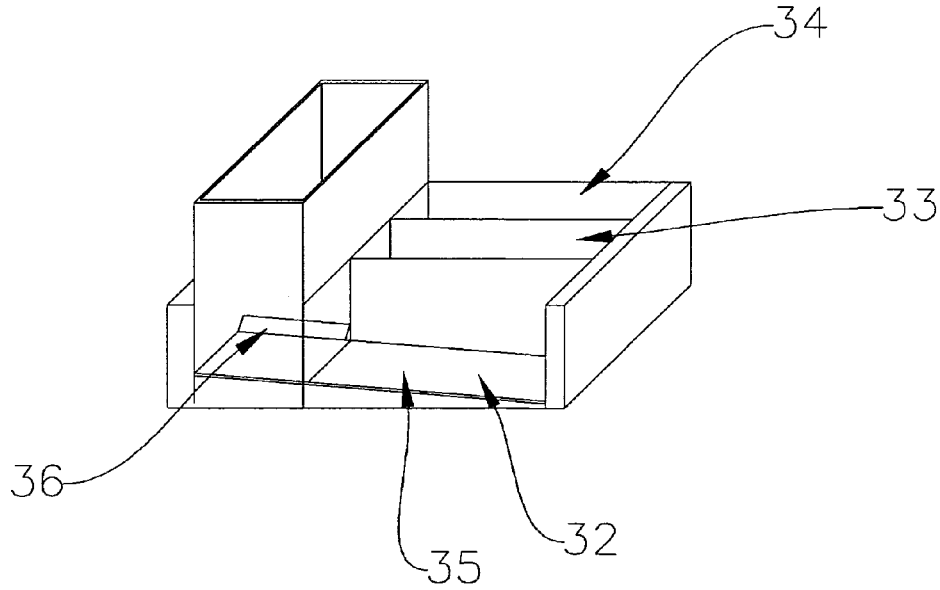
FIG. 4 is a cutaway perspective view of the long side of the present invention.
Figure 5:
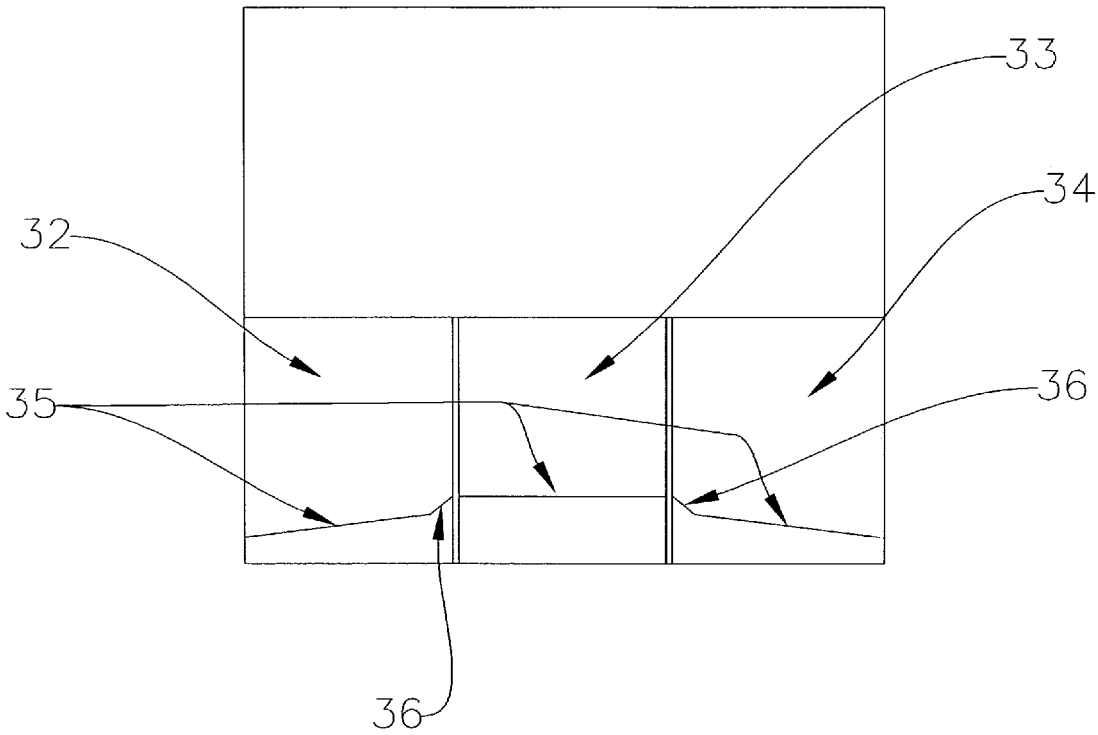
FIG. 5 is a planar cut-a-way end view of the present invention.
Figure 12:
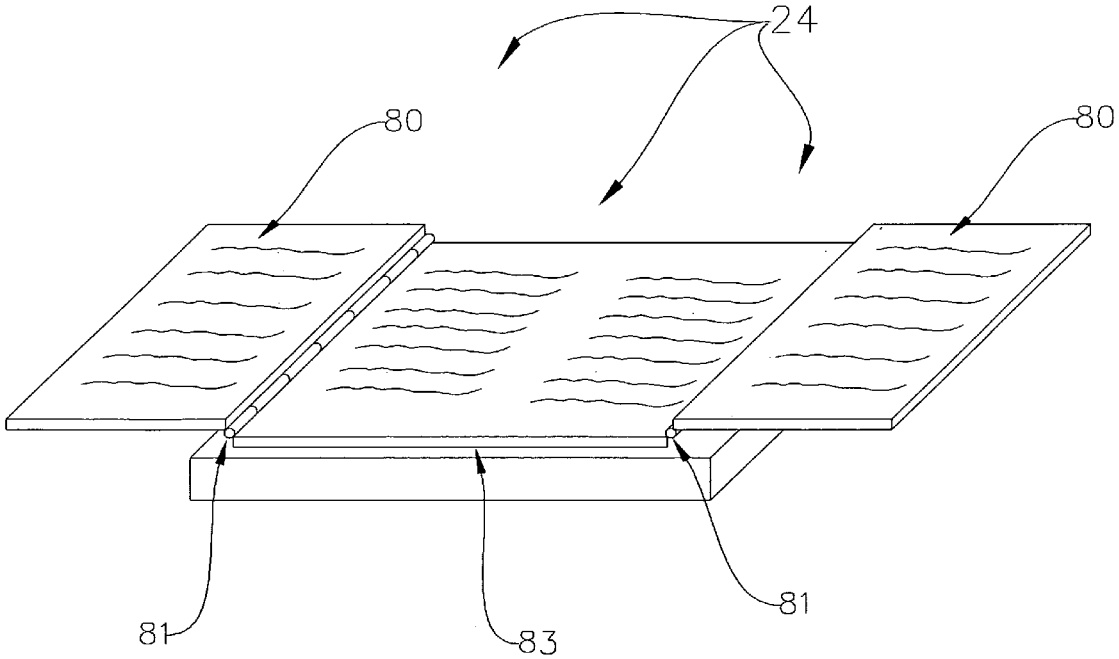
FIG. 12 is a perspective view of the columbarium lid of the present invention.
Figure 13:
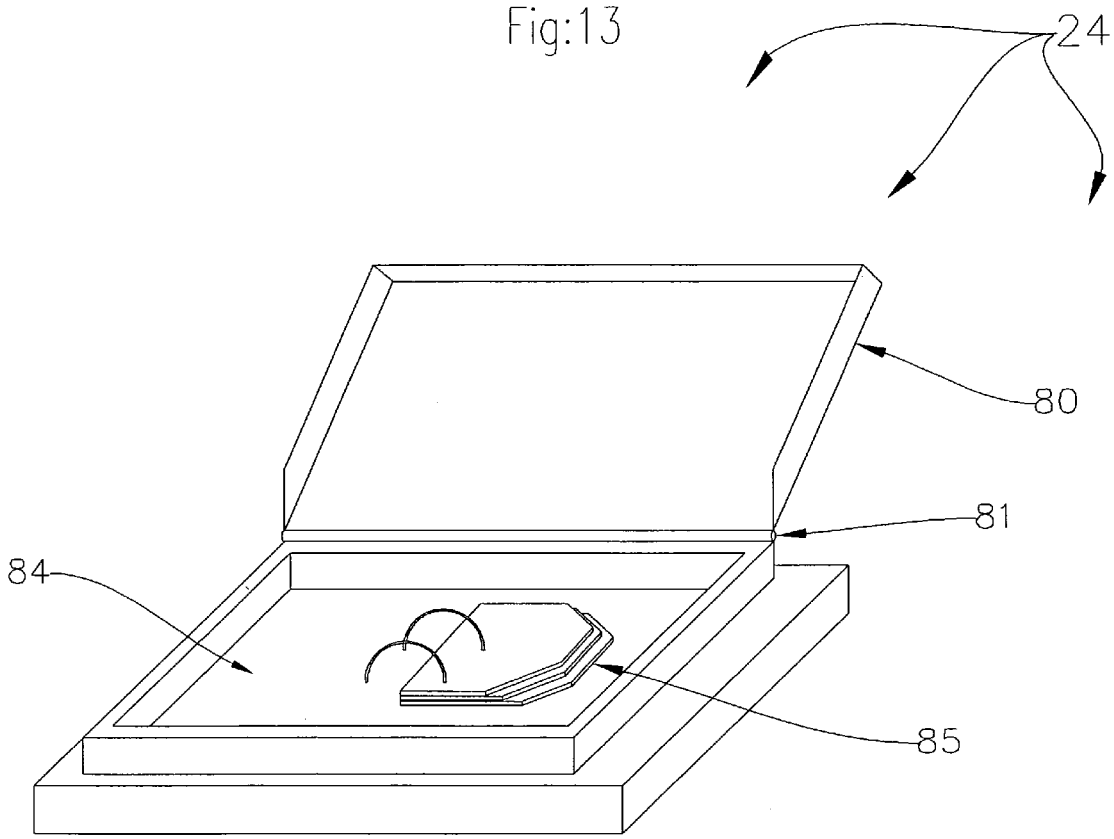
FIG. 13 is a perspective view of an alternate embodiment of the lid of the present invention.

As shown in FIG. 3, the lid 24 of the columbarium 20, shown in greater detail in FIGS. 13 and 14, can be removed from the columbarium body 25 thereby gaining access to the top inside portion of the columbarium 20. A resilient seal (not shown) could be placed between the lid 24 and the columbarium body 25 as a means to prevent the entrance of water and debris. The lid 24 can be locked or secured (locking device not shown) to the columbarium body 25 as a means of securing the lid, if desired. The lid 51 of the telescoping tube, shown in detail in FIGS. 8, 9, 10 and 12, is depicted in its fully downward position resting on the cylindrical tube 31. FIGS. 4 and 5 depict a cut-a-way view of the long side of the "L" shaped columbarium 20 and a cut-a-way end view of the long side of the columbarium 20 respectively. As depicted, there are three (3) separate storage chambers 32, 33, and 34 within the columbarium for the storage of spherical urns. The storage chambers 32, 33, and 34 each have a slanted ramp 35 which provide a means for any deposited spherical urns to roll by gravitational force to their end resting position, A greater or lesser number of storage chambers 32, 33, and 34 could be placed horizontally over the existing coffin depending upon the size of the existing burial plot. A second set of ramps 36

(only one of which is shown) provides a means for allowing the opening in the telescoping tube to be positioned such that the spherical urn can be placed into the proper storage chamber 32, 33 or 34.

Figure 6:
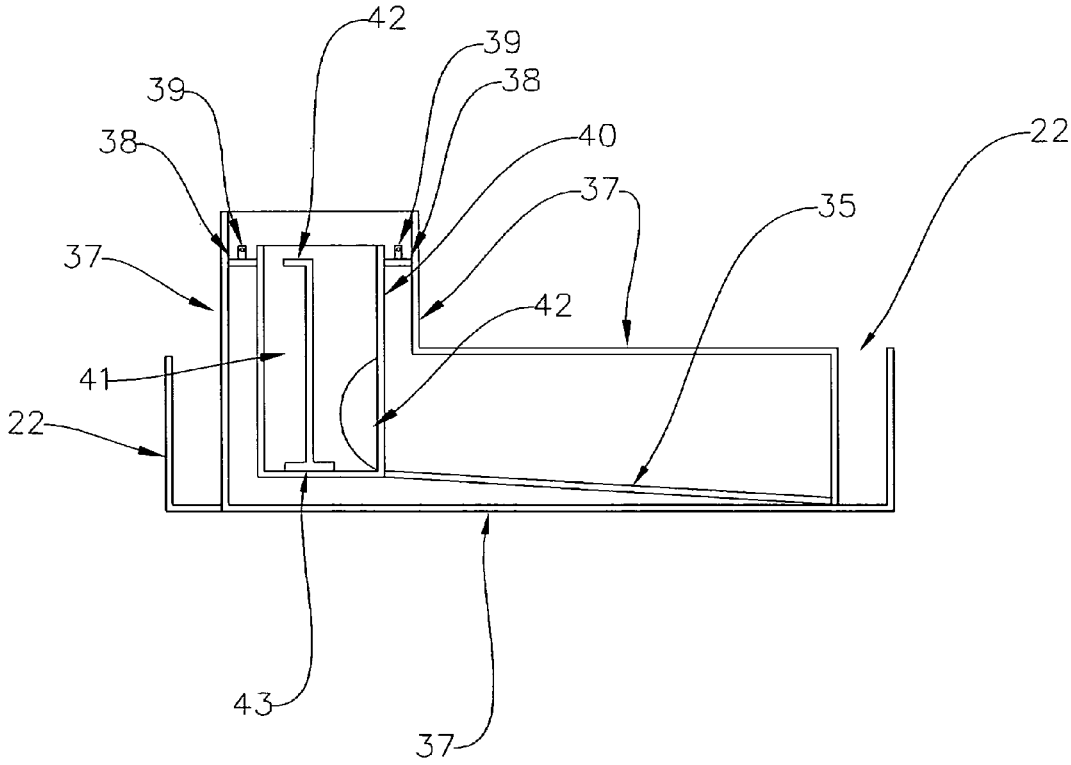
FIG. 6 is a planar cut-a-way side view of the present invention.

FIG. 6 depicts a cut-a-way view of the columbarium body 25. The anchoring means 22 can either be solid or open to allow for concrete or other anchoring material (not shown) to be filled in. The exterior walls 37 of the columbarium body 25 can be made of any reasonably weather resistant material such as, but not limited to metal or plastic. Permanently fixed to the inside of the columbarium body 25 is and inner horizontal plate 38. Attached to the inner horizontal plate 38 are a plurality of brackets 39 which provide a means for securing the telescoping tube to the columbarium body 25. Fixedly attached to the horizontal plate 38 is the cylindrical tube 40. A plurality of vertical slots 41 are located in the cylindrical tube 40 that allow for the telescoping tube to be raised and lowered and turned within the cylindrical tube, while providing a means to prevent the telescoping tube from being removed from the cylindrical tube 40. A resilient seal (not shown) could be placed between the cylindrical tube and the top of the telescoping tube as a means for preventing the entrance of water or debris. At both ends of the vertical slots 41 there are attached horizontal slots 42 and 43. The upper horizontal slot 42 allows the telescoping tube to be rotated slightly such that the urn can be placed within the telescoping tube without having someone hold the telescoping tuber in place, thereby providing a means for making the urn available for viewing during the internment proceedings. The lower horizontal slot 43 allows the telescoping urn to be rotated either right or left in order to align the telescoping tube and accompanying urn towards the proper storage chamber 32, 33, or 34.

Figure 7:
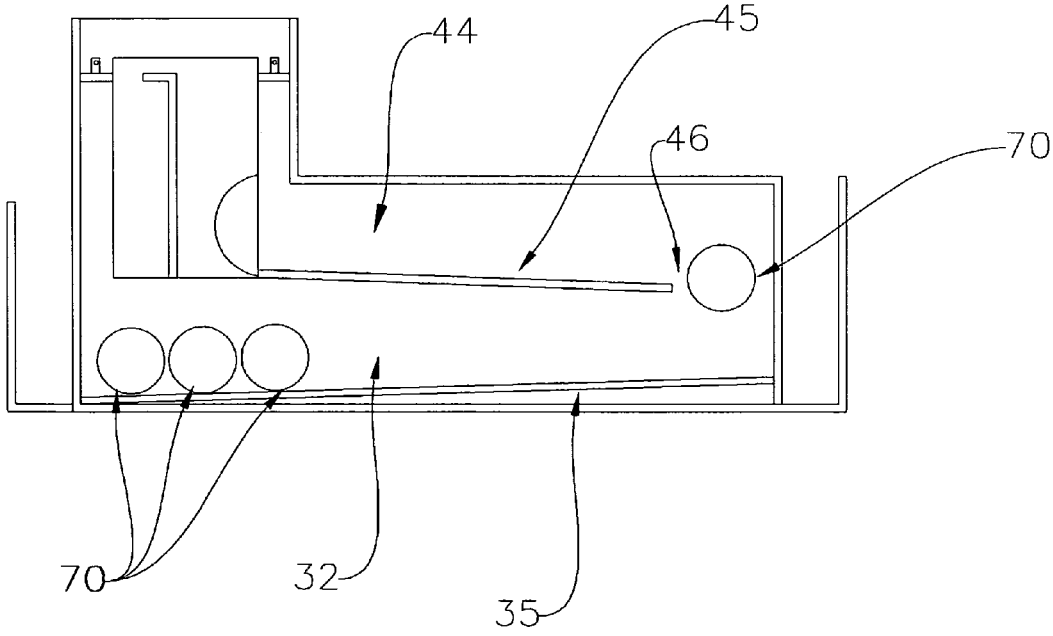
FIG. 7 is a planar side cut-a-way side view of an alternate embodiment of the present invention.

In an alternative embodiment, depicted in FIG. 7, there is shown a columbarium body 25 wherein there are two vertical stacked horizontal storage chambers 32 and 44 being separated by a second horizontal ramp 45. The second horizontal ramp 45 having an opening 46 that allows a spherical urn 70 to roll down the upper ramp 45, fall through the opening 46 and continue rolling down the lower ramp 35 to the urns final resting position.

Figure 8:
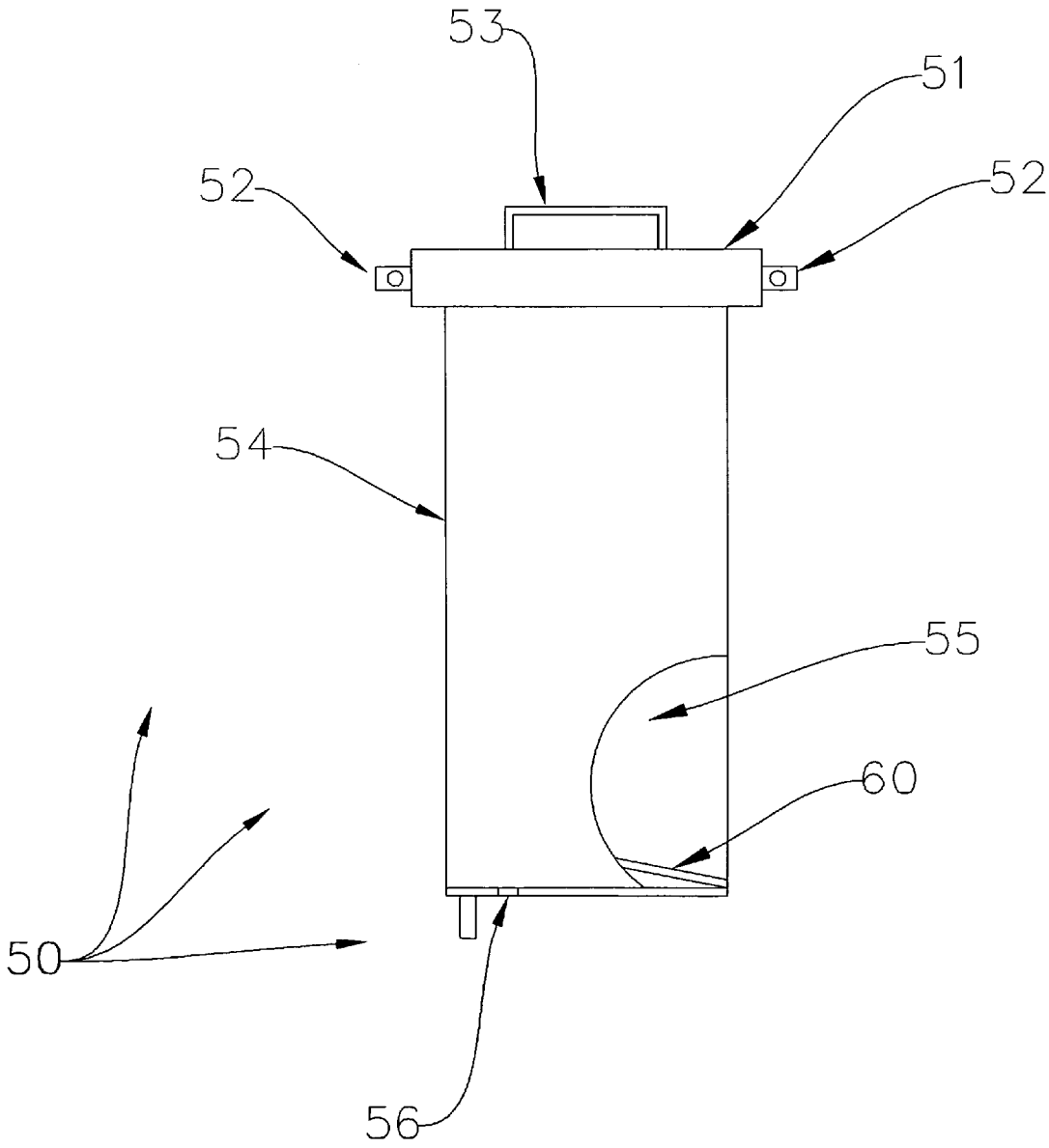
FIG. 8 is a planar side view of the telescoping cylinder of the present invention.

FIG. 8 depicts the telescoping tube 50. The telescoping tube 50 has a fixedly attached lid 51. The lid 51 has a plurality of tabs 52 for securing the telescoping tube 50 to the inner horizontal plate 38 and a handle 53 as a means for raising, lowering and rotating the telescoping tube 50. There is an opening 55 at the base of the telescoping tube 50 as a means for allowing an urn to roll out of the telescoping tube 50. There are a plurality of extended tabs 56 at the base of the telescoping tube 50 which ride in the slots 41, 42 and 43 in the cylindrical tube 40. There is a spring biased pivotal base 60 attached to the base of the telescoping tube 50.

Figure 9:
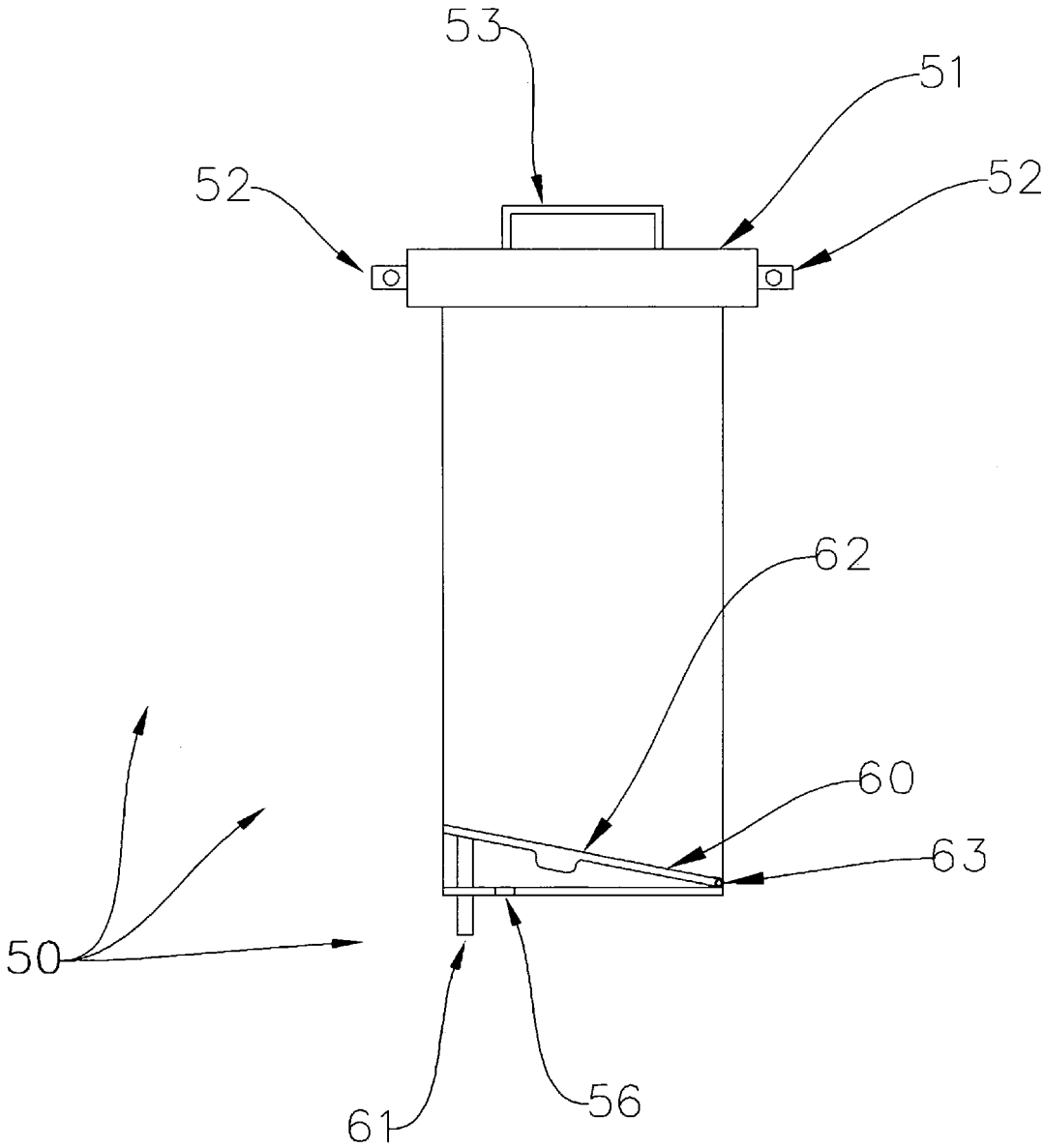
FIG. 9 is a planar cut-a-way side view of the telescoping cylinder of the present invention.
Figure 10:
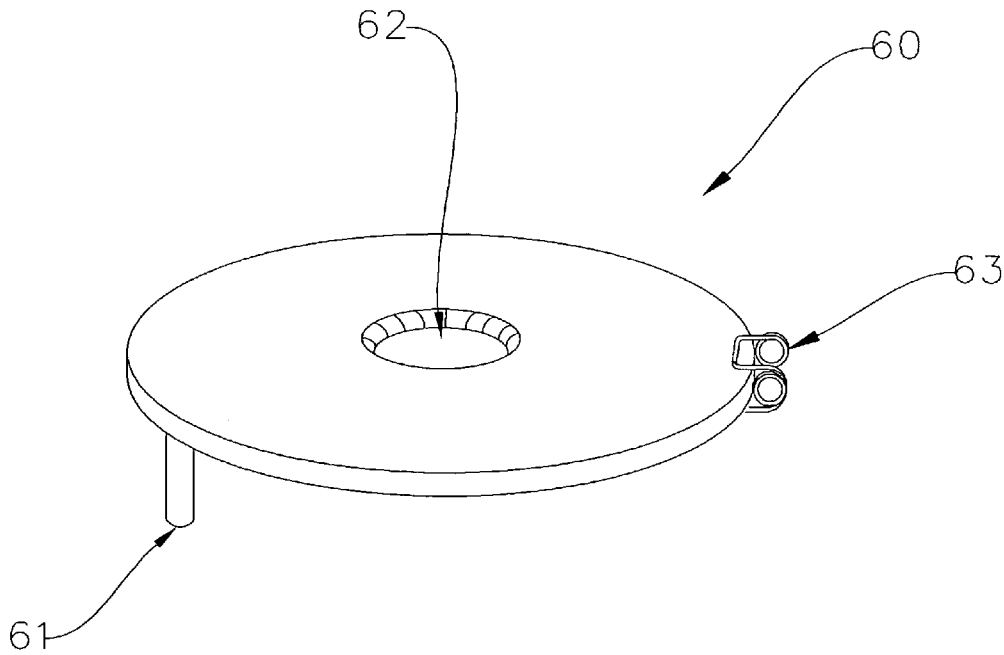
FIG. 10 is a perspective view of the pivoting base plate of the telescoping cylinder of the present invention.

FIG. 9 is a cut-a-way side view of the telescoping tube 50. The pivotal base 60 has a push aim 61 attached to the bottom of the pivotal base 60, a recessed divot 62 in the center of the pivotal base 60 for holding an urn and a hinged spring 63 biasing the pivotal base 60 to a normally horizontal position. FIG. 10 is a perspective view of the pivotal base 60.

Figure 11:
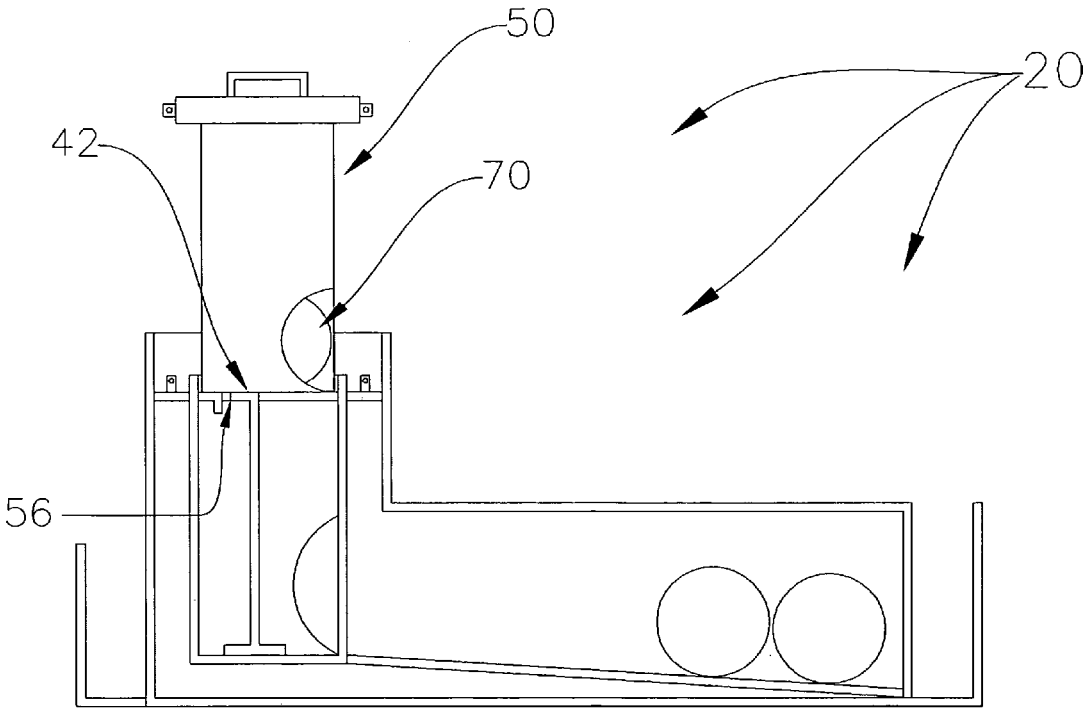
FIG. 11 is a planar cut-a-away side view of the present invention depicting the telescoping cylinder at its full upward position.

FIG. 11 is a cut-a-way view of the columbarium 20, without the columbarium lid 24, Showing the telescoping tube 50 in its fully upward position being held in place by the tabs 56 located in the upper horizontal slot 42. There is an urn 70 placed inside of the telescoping tube and viewable by the mourners during the internment proceedings.

FIG. 12 is a preferred embodiment of the columbarium lid 24. The lid 24 has two door like covers 80 that can be opened by pivoting the covers on the hinges 81. Inside of the covers and the corresponding inside base 83 can be inscribed with the names and other particulars of the deceased. In an alternative embodiment of the columbarium lid 24, depicted in FIG. 13, the cover 80 hinges 81 backward to reveal an open area 84 into which is placed the particulars of each deceased person interned in the columbarium 20 in a ring-like type plaque 85. There can be means for securely locking (not shown) the lid 24 to the columbarium body 25 and the covers 80 to the columbarium lid 24 if desired. Locking means are well known in the art.

In practice, the means for interning the cremated remains of a deceased individual above a pre-existing coffin style burial of a predeceased individual comprises the following steps. First, an area above the pre-existing coffin is excavated, leaving the original headstone intact and un-moved. Next, the "L" shaped columbarium 20, placed such that the long part of the "L" is horizontal, is placed in the excavation and anchoring materials are used to fix the columbarium 20 substantially, but not entirely under ground. The columbarium 20 is then backfilled and grass or other appropriate surface material placed on top of the excavation for cover. The short part of the "L" remains above ground. When it comes time to intern the remains of a cremated individual, the ashes of the individual are sealed in a spherical urn 70.

The columbarium lid 24 has any locks (not shown) removed and the lid 24 is then removed or lifted back. The telescoping tube 50 is then unsecured from the inner horizontal surface 38 and lifted up close to the top of the cylindrical tube 40 following in the vertical slots 41 in the cylindrical tube 40. The telescoping tube 50 is then rotated slightly such that the tabs 56 on the base of the telescoping tube 50 slide into the horizontal slots 42 near the top of the cylindrical tube 40. This arrangement provides a means for the telescoping tube to remain in an upward position without the aid of people holding the telescoping tube 50. The horizontal and vertical slots 41, 42, and 43, operating with the tabs 56 at the base of the telescoping tube 50, allow the telescoping tube 50 to be raised and lowered vertically and, when the telescoping tube 50 is at its upper or lower position, allows the telescoping tube 50 to be rotated while providing a means for assuring that the telescoping tube 50 can not be removed entirely from the cylindrical tube 40.

Once the telescoping tube 50 is in its fully upward position and stable in the horizontal slots 42, a spherical urn 70 can be placed on the spring loaded pivotal base 60 of the telescoping tube 50. The spring loaded pivotal base 60 is spring biased to be in a normally horizontal position. A divot or recessed area 62 in the center of the pivotal base 60 provides the means to hold the urn 70 in position for viewing during the internment proceedings.

When it is time to intern the urn 70, a user rotates the telescoping tube 50 in order to align the tabs 56 with the vertical slots 41 and then lowers the telescoping tube 50 to its lowest position in the cylindrical tube 40. As the telescoping tube 50 nears its lowest position in the cylindrical tube 40, a push arm 61 attached to the pivotal base bottoms out at the base of the cylindrical tube 40, overcomes the spring 63 tension on the pivotal base 60 and tilts the pivotal base 60. Once the pivotal base 60 is tilted, the urn 70 rolls off of the pivotal base 60 by gravitation force and roles onto a slanted ramp 35 and downward into a permanent storage chamber 32, 33, and 34 for the urn 70.

The telescoping cylinder 50 is then re-secured to the inner horizontal surface 38 and the columbarium lid 24 replaced and re-secured to the top of the columbarium 20. Any relevant information is then recorded in or on the cover 80 of the columbarium lid 24. In the alternative, the original headstone could be removed and the "L" shaped columbarium lengthened to allow for a greater storage capacity of urns. The particulars of the pre-deceased coffin style burial would then be included in the cover 80 of the present columbarium.

As should be understood by the description read in conjunction with the drawings, the present invention allows for the internment of a plurality of cremated remains being placed over a pre-existing buried coffin style casket burial thereby providing for a more efficient use of available cemetery space, particularly for group or familial internments.

I claim:

1. An "L" shaped cremation storage apparatus for storing a plurality of cremated remains such that said remains are inaccessible once they are interned, each said cremated remains contained in a separate spherical urn, said storage apparatus being substantially, but not entirely, buried in the earth with the long side of the "L" shape being substantially horizontal above a pre-existing buried coffin and in front of a pre-existing cemetery monument, said apparatus comprising;

an "L" shaped exterior housing;

a plurality of anchoring means to anchor said apparatus into said earth;

at least one internal ramp inside of said long side of said apparatus for the storage of said urns;

a vertical cylindrical tube with a plurality of slots cut out of said cylindrical tube and an opening in the base of said cylindrical tube, said cylindrical tube fixed to a horizontal plate, said horizontal plate being fixed to the inside of the short side of said "L" shaped apparatus;

a telescoping tube which is slidable and rotatable within said cylindrical tube guided by said slots cut out of said cylindrical tube, said telescoping tube not removable from said cylindrical tube and having a handle for raising, lowering and rotating said telescoping tube and opening in said telescoping tube for the placement of said urn;

a spring biased pivotal base in said telescoping tube with a divot in the center of said pivotal base for holding said spherical urn;

a lid for the exposed portion of the apparatus; and a place on said lid for the inscription of a deceased's individual's particulars.

2. The apparatus according to claim 1 further comprising a resilient seal between said cylindrical tube and said telescoping tube to prevent water and debris from entering said apparatus.

3. The apparatus according to claim 1 further comprising a resilient seal between said lid and the exposed portion of said apparatus to prevent water and debris from entering said apparatus.

4. The apparatus according to claim 1 further comprising a locking mechanism to secure said lid to said apparatus.

5. The apparatus according to claim 1 further comprising a locking mechanism to secure said telescoping tube to said to said apparatus.

6. The apparatus according to claim 1 further comprising a plurality of ramps laid horizontally parallel to each other thereby creating a plurality of storage areas and ramps allowing a user to select which said storage space said urn is deposited upon for storage.

7. The apparatus according to claim 1 further comprising a plurality of ramps stacked vertically to each other such that there are created upper and lower ramps with an opening in said upper ramps to allow for the passage of said urn from said upper ramps to said lower ramps.

8. The apparatus according to claim 1 further comprising at least one door to cover said inscription from exposure to water and debris, the outside of said door being inscribed with a familial name.

9. A means for interning a plurality of cremated remains in an "L" shaped columbarium such that said remains are inaccessible once they are interned, each said cremated remains contained in a separate spherical urn, said storage apparatus being substantially, but not entirely, buried in the earth with the long side of the "L" shape being substantially horizontal above a pre-existing buried coffin and in front of a pre-existing cemetery monument, said means comprising;

opening up the top of said columbarium;

raising up a telescoping tube up in a cylindrical tube fixed to said columbarium contained within said columbarium, said telescoping tube slidable and rotatable within said cylindrical tube but not removable therefrom;

rotating said telescoping tube such that said telescoping tube rests in said cylindrical tube in an upward position;

placing said urn in a divot on a horizontal pivotal base within said telescoping tube for viewing purposes during an interment ceremony;

rotating and lowering said telescoping tube with said urn into said cylindrical tube;

using a push arm to pivot said pivotal base such that said urn rolls off of said pivotal base by gravitational force onto a ramp for final storage of said urn;

closing said top of said columbarium; and inscribing the particulars of the deceased to a plaque attached to said lid.

10. The means according to claim 9 further comprising a releasable locking means to secure said lid to said columbarium.

11. The means according to claim 9 further comprising a means to provide a resilient seal between said lid and said columbarium to prevent water and debris from entering said columbarium.

12. The means according to claim 9 further comprising a releasable locking means to secure said telescoping tube to said columbarium.

13. The means according to claim 9 further comprising a means to provide a resilient seal between said telescoping tube and said cylindrical tube to prevent water and debris from entering said columbarium.

14. The means according to claim 9 further comprising a plurality of ramps laid horizontally parallel to each other thereby creating a plurality of storage areas.

15. The means according to claim 9 further comprising a plurality of ramps stacked vertically parallel to each other with an opening in the upper ramps to allow for the passage of said urn from and upper ramp to a lower ramp.

16. The means according to claim 9 further comprising at least one door to cover said inscription from exposure to water and debris, the outside of said door being inscribed with a familial name.

* * * * *